US009151090B2

(12) United States Patent
Beck

(10) Patent No.: US 9,151,090 B2
(45) Date of Patent: Oct. 6, 2015

(54) SECURE DOOR HANDLE UNIT

(75) Inventor: Andreas Beck, Bochum (DE)

(73) Assignee: HUF HULSBECK & FURST GMBH & CO. KG (DE)

( * ) Notice: Subject to any disclaimer, the term of this patent is extended or adjusted under 35 U.S.C. 154(b) by 264 days.

(21) Appl. No.: 13/541,145

(22) Filed: Jul. 3, 2012

(65) Prior Publication Data

US 2013/0056999 A1 Mar. 7, 2013

(30) Foreign Application Priority Data

Jul. 6, 2011 (DE) ..... 10 2011 051 617

(51) Int. Cl.

| | |
|---|---|
| ***E05B 3/00*** | (2006.01) |
| ***E05B 85/14*** | (2014.01) |
| ***E05B 77/02*** | (2014.01) |
| ***E05B 77/04*** | (2014.01) |
| ***E05B 77/06*** | (2014.01) |
| *E05B 65/10* | (2006.01) |

(52) U.S. Cl.

CPC ..... *E05B 85/14* (2013.01); *E05B 77/02* (2013.01); *E05B 77/04* (2013.01); *E05B 77/06* (2013.01); *Y10S 292/22* (2013.01); *Y10T 292/57* (2015.04)

(58) Field of Classification Search

CPC ..... E05B 77/02; E05B 77/04; E05B 77/06
USPC ..... 292/336.3, DIG. 22
See application file for complete search history.

(56) References Cited

U.S. PATENT DOCUMENTS

| | | | | |
|---|---|---|---|---|
| 3,719,248 | A * | 3/1973 | Breitschwerdt et al. | 180/271 |
| 5,669,642 | A * | 9/1997 | Kang | 292/336.3 |
| 6,042,159 | A * | 3/2000 | Spitzley et al. | 292/216 |
| 6,460,904 | B1 * | 10/2002 | Stapf | 292/336.3 |
| 6,471,262 | B1 * | 10/2002 | Schwab | 292/336.3 |
| 6,648,382 | B1 * | 11/2003 | Monig et al. | 292/336.3 |
| 7,029,042 | B2 * | 4/2006 | Belchine, III | 292/336.3 |
| 7,059,641 | B2 * | 6/2006 | Chanya | 292/336.3 |
| 7,635,151 | B2 * | 12/2009 | Rodawold et al. | 292/336.3 |
| 8,038,185 | B2 * | 10/2011 | Wood | 292/336.3 |

(Continued)

FOREIGN PATENT DOCUMENTS

| | | | |
|---|---|---|---|
| DE | 19929022 | A1 | 1/2001 |
| DE | 102009053553 | A1 | 5/2011 |

(Continued)

*Primary Examiner* — Carlos Lugo
(74) *Attorney, Agent, or Firm* — Cantor Colburn LLP

(57) ABSTRACT

The invention relates to a door handle unit for a lock in a vehicle with a door handle to open a door by a user, an operating unit showing at least the door handle, a coupling unit, or a combination of the door handle and the coupling unit, where by the mechanical coupling unit a motion of the door handle from a resting position into a operating position can be transferred to the lock, a crash block with a normal position, allowing a motion of the operating unit to operate the lock, and with a blocking position, which results during or after the impact of a force of acceleration, blocking any motion of the operating unit such that any operation of the lock is prevented, characterized in that the crash block in its blocking position can be transferred by a motion of the operating unit into the normal position.

55 Claims, 5 Drawing Sheets

(56) References Cited

U.S. PATENT DOCUMENTS

| | | | | |
|---|---|---|---|---|
| 8,152,209 | B2 * | 4/2012 | Lee | 292/336.3 |
| 8,167,342 | B2 * | 5/2012 | Bertolotti | 292/336.3 |
| 2010/0207404 | A1 | 8/2010 | Corwin et al. | |
| 2011/0115240 | A1 | 5/2011 | Muller et al. | |
| 2011/0181052 | A1 | 7/2011 | Brose et al. | |
| 2011/0181058 | A1 * | 7/2011 | Bland | 292/336.3 |
| 2012/0061162 | A1 * | 3/2012 | Savant et al. | 180/274 |

FOREIGN PATENT DOCUMENTS

| | | | |
|---|---|---|---|
| DE | 202009017667 | U1 | 6/2011 |
| DE | WO 2013053346 | * | 4/2013 |
| EP | 1593802 | A1 | 11/2005 |
| EP | 2325419 | A2 | 5/2011 |
| FR | 2876135 | A1 | 4/2006 |
| FR | 2940813 | A1 | 7/2010 |
| WO | 2006003197 | A1 | 1/2006 |
| WO | 2012028325 | A2 | 3/2012 |

* cited by examiner

SECURE DOOR HANDLE UNIT

TECHNICAL FIELD

The present invention relates to a door handle unit for a lock in a vehicle with a door handle to open a door, hatch, or the like by a user, being supported in an articulate fashion in a bearing chamber. Further, the invention also relates to a method for securing a door handle unit for a lock in a vehicle with a door handle for opening a door, hatch, or the like by the user, which is supported in an articulate fashion in a bearing frame. The door handle of such a door handle unit comprises at least one resting position and one operating position. Further, a mechanic coupling unit is provided, by which a motion of the door handle from its resting position into its operating position can be transferred to a lock in order to allow opening the lock, thus allowing to also open the door, hatch, or the like. Furthermore, the crash block provides at least one normal position and one blocking position, with the crash block in its normal position allowing a motion of the door handle and/or the coupling unit to operate the lock and in the blocking position, which is given during or after the impact of an acceleration, particularly caused by an accident, blocks any motion of the door handle and/or the coupling unit such that an operation of the lock is prevented or hindered.

BRIEF DISCUSSION OF RELATED ART

Various measures are implemented in such door handle units in order to, e.g., prevent in a lateral impact any unintentional motion of the door handle and thus an opening of the lock. For example, such door handle units may be equipped, on the one hand, with a counter-weight in order to compensate the weight of the door handle. Additionally, a crash block may be used preceding any potential motion of the door handle under the impact of an acceleration in order to block the motion of the door handle in advance. The publication DE199 29 022 C2 is named as prior art, for example. In this door handle unit, too, the crash block serves as a rapid safety means locking the door handle in a form-fitting fashion in its resting position and the weight block serves as an inert safety counteracting the force of acceleration at the door handle in general.

Furthermore, it is known from the publication DE10 2009 053 553 A1 that by the rapid crash block an additional force affects the door handle, by which it shall also be securely prevented that any unintentional motion of the door handle occurs. After its initial activation, this crash block can only be deactivated by a targeted engagement of the door handle unit so that the door handle can once more be used in its normal operation. Usually the adjustment of the crash block from the activated position to the deactivated position occurs by a trained specialist in a garage.

BRIEF SUMMARY

Thus, the invention provides a door handle unit and a safety method therefor, which securely keep the door, hatch, or the like closed even under differently impacting forces of acceleration, for example caused by a crash, using the provided crash block, with the door handle after activation of the crash block can be returned to normal operation by way of a common operation of the door handle.

Here, it shall already be mentioned that the features disclosed in the claims and the description as well as in the drawings may each be essential for the invention individually or in any combination. Features and details described in the context with the method according to the invention are here applicable with the door handle unit according to the invention and vice versa, of course.

The door handle unit according to the invention serves in a vehicle to open a door, rear hatch, glove compartment lid, or the like (in the following text only called door for simplification) by a user, in which the provided lock can be operated. Usually, a door handle is arranged in an articulate fashion at an exterior side of the door, with the door handle directly or indirectly being supported in an articulate fashion in a bearing frame, which is commonly arranged at an interior side of the door. The door handle itself may assume at least one resting position and one operating position, where the motion of the door handle from the resting position into the operating position can be transferred via a mechanical coupling unit to the lock at the door. The mechanical coupling unit can also be arranged in a pivotal or articulate fashion in a bearing frame of the door handle and be in a mechanically effective connection to the door handle. Generally, the motion of the mechanical coupling unit introduced by the door handle can be transferred directly or indirectly via a transfer element to the lock of the door. Within the scope of the invention, an operating unit shall comprise the door handle and/or the mechanical coupling unit. This transfer element may comprise, e.g., a rod, a Bowden-cable, or the like. Furthermore, the door handle unit comprises a crash block, which may show at least one normal position and one blocking position. In the normal position, the crash block allows a common motion of the door handle and/or the coupling unit (or the operating unit, respectively) in order to operate the lock. In the blocked position, which is given during or after the impact of an acceleration, particularly in case of a crash, any motion of the door handle and/or the coupling unit (or the operating unit, respectively) is blocked such that any operation of the lock is prevented. This case is also called the activation of the crash block. Consequently, the present crash block secures the door handle from any unintentional motion in case of a crash, in order to here prevent any opening of the lock and thus an opening of the door at the vehicle in case of a crash.

According to the invention, it is provided in this door handle unit that the crash block in its blocked position can be transferred into its normal position by a motion of the door handle and/or the coupling unit. Due to the fact that the crash block is already in its blocking position, an impact of the force of acceleration has already occurred upon the door handle; thus the crash block has been activated into its blocking position. From this blocking position, the crash block can only be transferred into the normal position by an additional motion of the door handle and/or the coupling unit. Here, this additional motion of the door handle is initially blocked by the crash block so that an operation of the lock continues to be prevented. Consequently, the usual operation of the door handle from its resting position into the operating position of the door handle cannot be performed because the crash block prevents the operating position from being reached. Only when the door handle is moved back in the direction towards its resting position can the crash block move into its normal position. Accordingly, even after a single triggering of the crash block, it is necessary that a repeated operation of the door handle from its resting position in the direction of its operating position is required in order to deactivate the crash block, with the crash block here being transferred at least from a blocking position into the normal position. However, during the initial operation of the door handle, said door handle fails to reach its operating position, because this motion is still blocked by the crash block, which is at least in a blocking position. Only when the crash block has once more assumed its normal position can the door handle be transferred from its resting position into the operating position, whereby the lock can be opened at the door.

Here, the crash block can only be transferred in its blocked position by a (common or usual) motion of the door handle and/or the coupling unit into the normal position. Consequently it is not necessary after a crash to see a garage in order to deactivate the crash block in the door handle unit or to return it into its normal position. This measure is replaced by the additional (unlocking) motion of the door handle and/or the coupling unit. Here, as described above, the door handle cannot be moved to its operating position.

Here, it shall also be pointed out that the motion of the door handle and/or the coupling unit to deactivate the crash block is equivalent to the normal pulling motion to open the lock. This way it is ensured that after an accident helpers from the outside can open the door by a normal operation of the door handle. Intuitively, these helpers will pull the door handle at least twice in order to open the door. This way it is ensured that aid can quickly be provided to the passengers, without it being necessary for such persons to be particularly trained in the opening of doors after a crash has occurred.

Furthermore, it may be provided that the crash block comprises at least two blocking positions, with here the crash block comprising a first blocking position by the impact of a force of acceleration, which is, however, only provided during the impact of a force of acceleration. Consequently, this first blocking position may represent a temporarily unstable position of the crash block from which the crash block can be returned into its normal position. Furthermore, the crash block may also show a second blocking position, in which the crash block is held steady, in particular temporarily. The crash block may also be transferred from a first blocking position directly into a second blocking position, regardless if any motion of the door handle and/or the coupling unit has occurred by the impact of the force of acceleration. In this second blocking position, the crash block can only be transferred back into its normal position by the above-described (unlocking) motion of the door handle and/or the coupling unit. In the following, this motion is also called the unlocking motion of the door handle and/or the coupling unit. For the purpose of clarification, it shall once more be mentioned that in its second blocking position the crash block also blocks a motion of the door handle and/or the coupling unit up to the operating position in order to this way securely prevent the operation of the lock. Only by a subsequent, second motion of the door handle can the door handle be transferred from its resting position into its operating position, thus realizing an operation of the lock. Due to the fact that the crash block is then once more in its operating position, it is capable of reacting to additional impacts of a force of acceleration, in order to perhaps once more allow blocking a motion of the door handle and/or the coupling unit.

Furthermore, it may be provided that the crash block and/or the coupling unit are supported in an articulate fashion at the bearing frame. For this purpose, respective axes may be provided, which are arranged in or at the bearing frame and about which the crash block and/or the coupling unit is/are supported in a rotational or articulate fashion. Further, the crash block and/or the coupling unit may be connected to a solid weight in order to allow automatically performing the desired motion upon the impact of a force of acceleration. However, due to its lower weight, the crash block temporarily precedes the coupling unit and thus it is securely possible to block the coupling unit in its blocking position. The coupling unit is of higher inertia due to its greater weight and thus it cannot follow the motion of the crash block with the same speed in the event of an accident.

In order to embed the crash block according to the invention in a particularly stable fashion in the door handle unit, an accept may be embodied, for example, in the form of a box-shaped frame with at least three sides, particularly comprising a bearing frame, in which the crash block is supported at its axis. This box-shaped accept prevents, on the one hand, objects from being able to penetrate the motion area of the crash block and, on the other hand, it counteracts the deformations that develop in a crash.

Optionally, it is therefore possible that the crash block is supported rotational about an axis and axially displaceable in reference to said axis in order to reach at least the normal position and one blocking position. By a rotation of the crash block about its axis, it can reach its first blocking position. Therefore, it is not necessary for the crash block to also be axially displaced longitudinally in order to reach the first blocking position, which is also possible, though. The second blocking position is reached by the crash block after it has been rotated out of its first blocking position opposite in reference to the first rotary direction and axially displaced longitudinally. In this second blocking position the crash block remains stable temporarily. The first blocking position of the crash block is embodied unstable, however, so that the crash block remains here only for a brief period of time and then moves into the normal position or perhaps the second blocking position. Regardless into which position the crash block is transferred then, it remains fully functional, though, so that upon another impact of a force of acceleration it is once more activated when it is taken out of its normal position or remains activated if it is still arranged in the second blocking position. This way it is ensured that, even in case of the door handle flapping, an operation of the lock is securely prevented.

In order to transfer the crash block from at least one blocking position into the normal position, the crash block can be mechanically stressed by a spring. This spring may particularly be embodied as a pressure and/or torsion spring and arranged between the bearing frame and the crash block. In order to save space, the spring may be embodied as a flat spring and arranged about the axis of the crash block. Further, the spring may also serve to transfer the crash block from the first blocking position into a second blocking position, with the spring being able to ensure a longitudinal displacement of the crash block on the axis. Consequently the spring may not only serve to return the crash block from the first blocking position in the direction towards the normal position, but simultaneously the spring may also serve to displace the crash block longitudinally on its axis, in order to reach the second blocking position.

In order to achieve that the crash block in every case blocks a motion of the door handle and/or the coupling unit under the impact of a force of acceleration, said crash block may block at least in one, preferably in all blocking positions the motion of the door handle and/or the coupling unit in a form-fitting fashion. In order to maintain the above-mentioned form-fitting connection, a projection may be provided at the door handle and/or the coupling unit mechanically cooperating with a stop at the crash block in a form-fitting fashion. This way, the crash block can be overcome in its blocked position only by destroying the door handle unit in order to transfer the door handle and/or the coupling unit directly into its operating position. Of course, a cinematic inversion is possible between the projection at the door handle and/or the coupling unit and the respective stop at the crash block in order to achieve the desired form-fitting connection in a blocking position of the crash block.

Furthermore, it may be provided that the crash block rotates in the first blocking position only about the axis and the crash block particularly comprises a first stop for the bearing frame. This stop may serve as a rotary stop or as a lateral guiding stop for the longitudinal displacement of the crash block. Furthermore, the crash block may comprise a second stop for the bearing frame which also serves as a rotary stop, particularly for the first blocking position. This second rotary stop may be arranged at a disc-shaped segment of the crash block, with this second stop being arranged projecting perpendicular in reference to the planar alignment of the disc-shaped segment. The disc-shaped segment of the crash block may further show a recess or a clear space serving, in the normal case, to allow that the projection can be guided past the crash block unhindered by the coupling unit so that an unhindered motion of the door handle or the coupling unit is possible between the resting position and the operating position. Furthermore, a third stop may be provided at the crash block, particularly arranged at the disc-shaped segment of the crash block and projecting from the planar surface of the disc-shaped segment, with this third stop, too, being able to cooperate with a counter-stop at the bearing frame. The third stop may be embodied arched. By this third stop the crash block can be held steady in the second blocking position. Consequently, the third stop prevents the crash block from being able to be easily turned back from the second blocking position in order to reach the normal position. In the second blocking position the crash block is rotated about its axis and displaced axially into its normal position.

The first and/or the second and/or the third stop cooperate in a form-fitting fashion with respective counter-stops at the bearing frame. These counter stops may also be fastened directly at the bearing frame.

Furthermore, it is possible that also the second stop of the crash block prevents an unlocking motion of the door handle and/or blocks the coupling unit in a form-fitting fashion, if the crash block was previously arranged in the second blocking position. This way, the second stop can accept several functions, in that it, on the one hand, limits the rotary motion of crash block in the first blocking position and, on the other hand, blocks the door handle and/or the coupling unit in the blocking position in a form-fitting fashion.

In the first blocking position of the crash block, the projection at the coupling unit can cooperate with the disc-shaped segment of the crash block, particularly in a form-fitting fashion. In this first blocking position, the crash block with the disc-shaped segment prevents the motion of the projection of the coupling unit such that it cannot be rotated further in the direction of the operating position. Here, the crash block may laterally contact with its first stop a counter stop at the bearing frame in order to counteract a longitudinal motion of the crash block by the pressure of the projection of the coupling unit.

In the second blocking position, the crash block may be rotated on the one hand and be longitudinally displaced on the other hand, with the third stop of the crash block cooperating in a form-fitting fashion with the respective counter-stop at the bearing frame. This form-fitting connection may only be released by a longitudinal displacement of the crash block in the direction towards the normal position. When now an (unlocking) motion of the door handle and/or the coupling unit is performed, the projection of the coupling unit presses onto the disc-segment at the crash block, whereby said crash block first has to be longitudinally displaced in order to allow any further motion of the door handle or the coupling unit in the direction towards the operating position. By this longitudinal displacement of the crash block, the form-fitting connection of the third stop with the respective counter frame at the bearing stop is released so that the crash block now can rotate freely in the direction of its normal position. Additionally, now the door handle and/or the coupling unit can be moved slightly further, with the projection of the coupling unit now, however, contacting in a form-fitting fashion the second stop, which is arranged perpendicularly at the disc-segment of the crash block, and in this position also being blocked in a form-fitting fashion. This way, any (unlocking) motion at the door handle and/or the coupling unit leads to the deactivation of the crash block, in that said crash block is laterally displaced from its second blocking position, with, however, the blockage between the coupling unit and the crash block not yet being released. Only after the door handle and/or the coupling unit has been moved back into the resting position can the operating position be reached, because in the meantime the crash block has once more assumed its normal position.

Within the scope of the invention, it may therefore be provided that the crash block releases the stable, second blocking position by an additional (unlocking) motion of the door handle and/or the coupling unit. Here, the additional motion of the door handle and/or the coupling unit may lead to an axial displacement of the crash block so that the third stop is without effect upon the bearing frame. Additionally, the second rotary stop of the crash block can prevent the additional motion of the door handle and/or the coupling unit in a form-fitting fashion.

Additionally, the present disclosure also relates to a method for securing a door handle unit for a lock in a vehicle, particularly showing the features of the characterizing part. Here, it is provided according to the disclosure that in its blocking position the crash block is transferred into the normal position by a motion of the door handle and/or the coupling unit. This motion relates to an unlocking motion of the door handle, which, however, cannot lead to an operation of the lock because the crash block still reliably blocks any motion of the door handle and/or the coupling unit.

The method according to the invention may be performed with a door handle unit according to the invention.

It is also possible that, upon the influence of a force of acceleration, the crash block is transferred into a first blocking position, particularly automatically, by way of a rotation, and an existing motion of the door handle and/or the coupling unit is blocked such that an operation of the lock is securely prevented. By this blocked motion of the door handle and/or the coupling unit, it can be achieved that the crash block subsequently returns to its normal position, because here no longitudinal displacement has occurred in order to transfer the crash block into the second blocking position. The return motion and the longitudinal displacement of the crash block may also occur automatically by the above-mentioned spring.

Within the scope of the invention it is also possible that the crash block is transferred from the stable second blocking position into its normal position exclusively by an additional (unlocking) motion of the door handle and/or the coupling unit. Here, the additional motion can initially be blocked by the crash block in a form-fitting fashion. Additionally, the crash block can only assume its normal position when the door handle itself is in its resting position.

BRIEF DESCRIPTION OF THE DRAWINGS

Additional advantageous embodiments of the invention are discernible from the following description, the claims, as well as the figures. In the figures, the invention is shown in a fundamental exemplary embodiment. In the figures:

DETAILED DESCRIPTION

Figure 1:
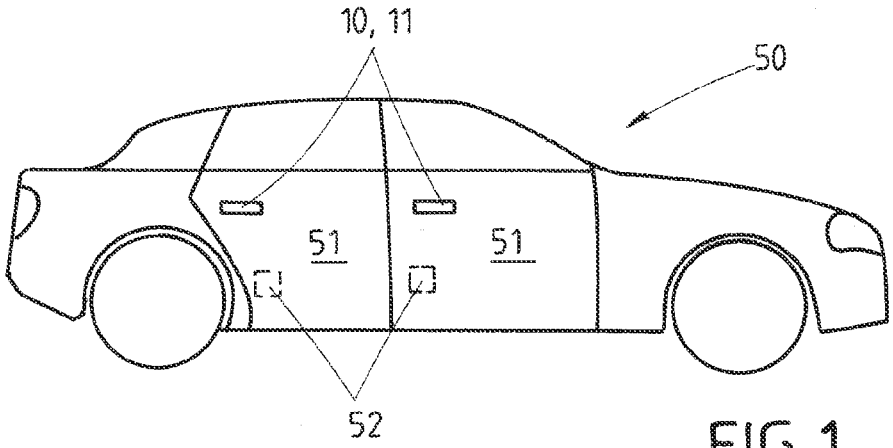
FIG. 1 shows a side view of a vehicle with two door handle units according to the invention.

In the following figures, identical technical features are marked with the same reference characters.

FIG. 1 shows a vehicle 50, particularly in the form of a passenger vehicle, which comprises, for example, four doors 51 which can be opened via the door handle units 10, particularly the door handles 11. The doors 51 are tightly closed by the respective locks 52 and can only be opened from the outside via an appropriate motion of the door handle 11. This motion at the door handle 11 may comprise a pulling and/or flipping motion. Here, the door handle 11 of the door handle unit 10 according to the invention is transferred from a resting position Ia into an operating position Ib, with the respective motion of the door handle 11 being mechanically transferred via a coupling unit 13 to the respective lock 52 of the door 11. By this motion of the door handle 11, the respective lock 52 and thus the door 51 can be opened. In the following FIGS. 2 through 10, a three-dimensional rear view of the door handle unit 10 is shown, with the focus here being given to the crash block 14. In order to render the invention better discernible in FIGS. 3, 4, 6, and 7, an illustration of the coupling unit 13 has been waived, which operates the respective lock 52 via a transfer element 13.

Figure 3:
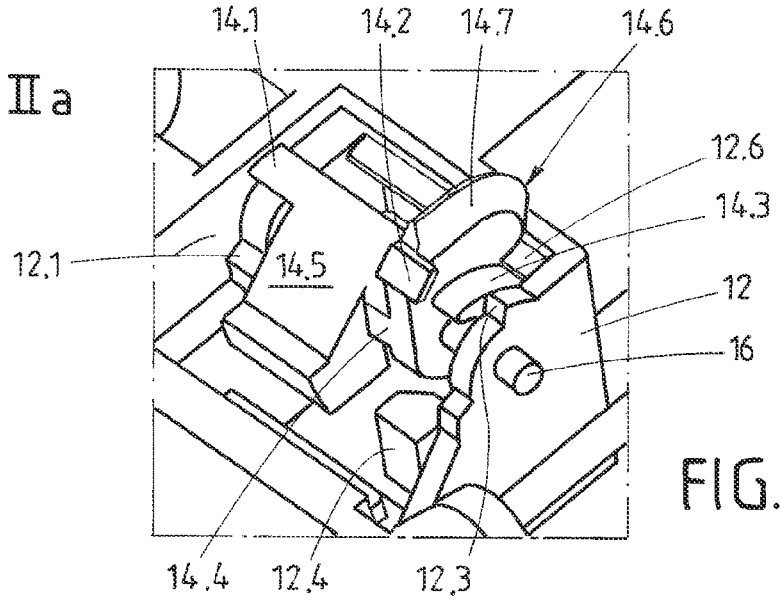
FIG. 3 shows a similar three-dimensional illustration of the crash block of FIG. 2 in its normal position.
Figure 4:
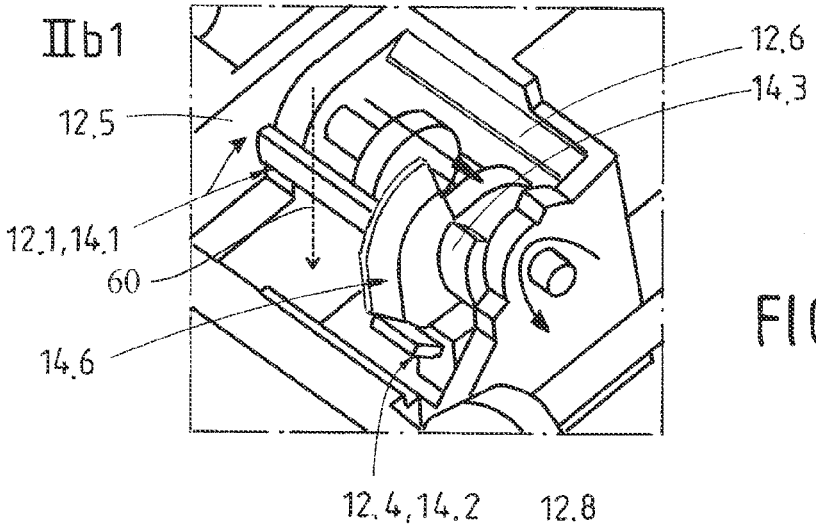
FIG. 4 shows a similar illustration of the crash block of FIG. 3 in a first blocking position of the crash block.
Figure 5:
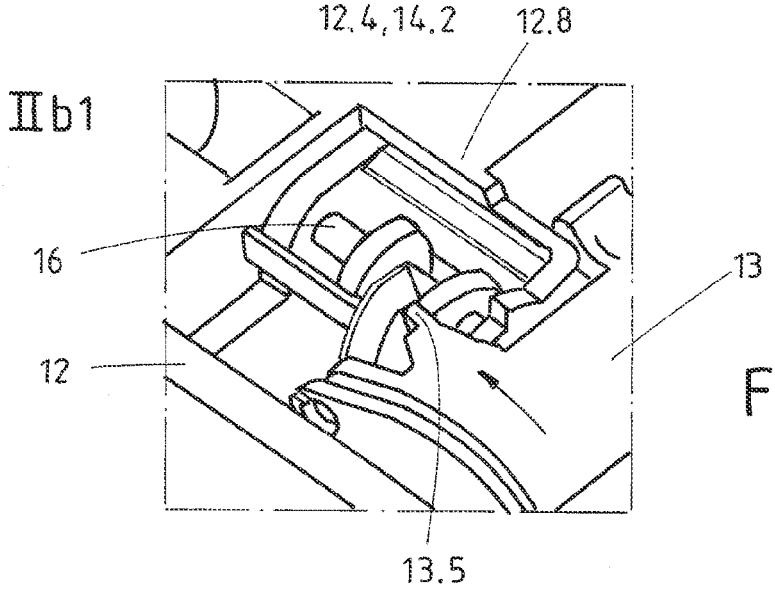
FIG. 5 shows a similar illustration of the crash block of FIG. 4, with, however, the coupling unit being shown.
Figure 6:
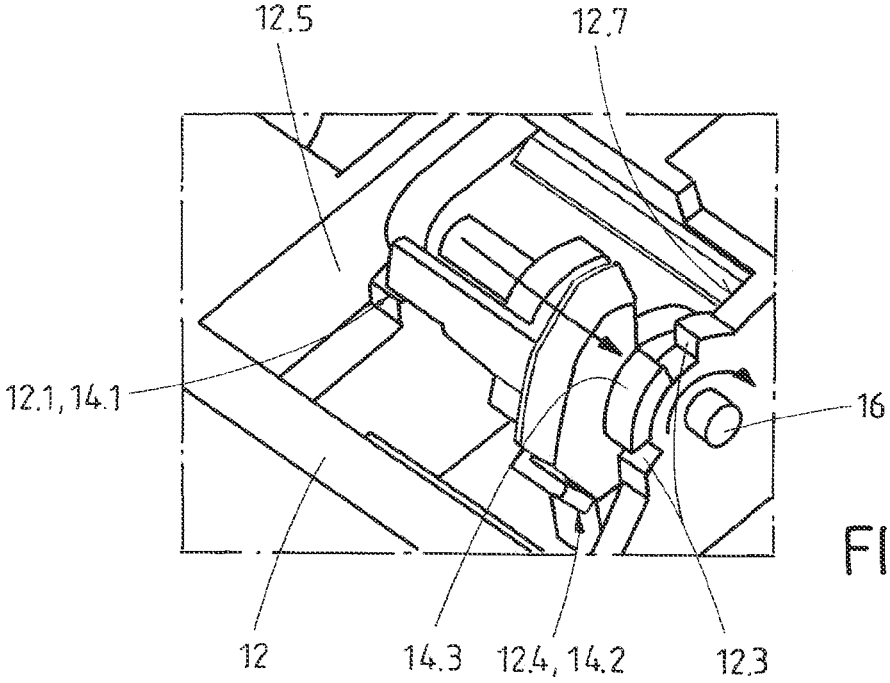
FIG. 6 shows a similar illustration of the crash block of FIGS. 3 and 4 without the coupling unit in an intermediate blocking position of the crash block.
Figure 7:
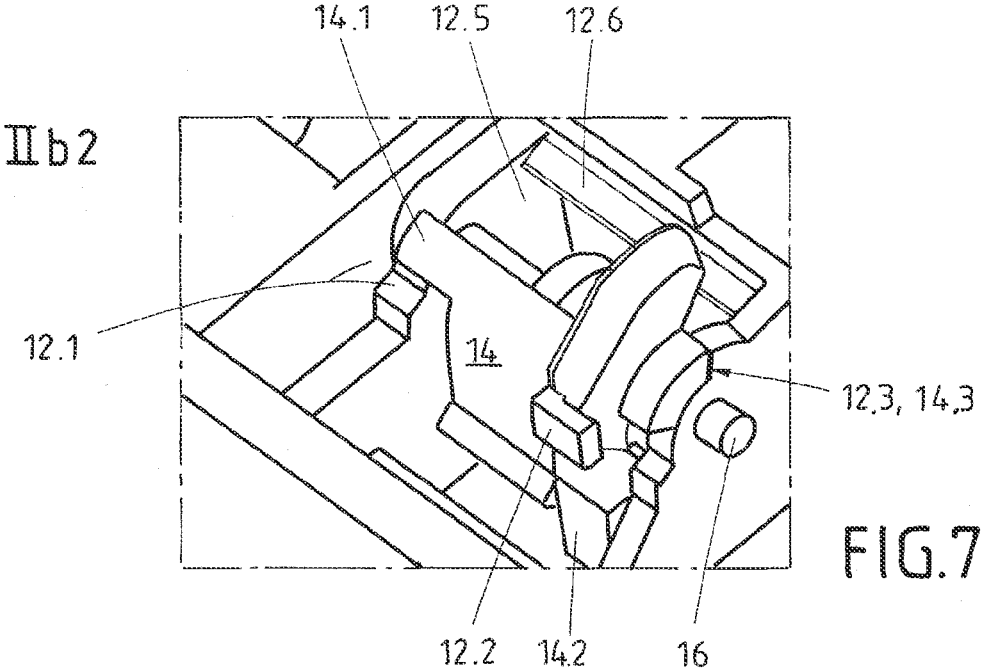
FIG. 7 shows a similar illustration of the crash block of FIG. 6 in a second blocking position of the crash block.
Figure 8:
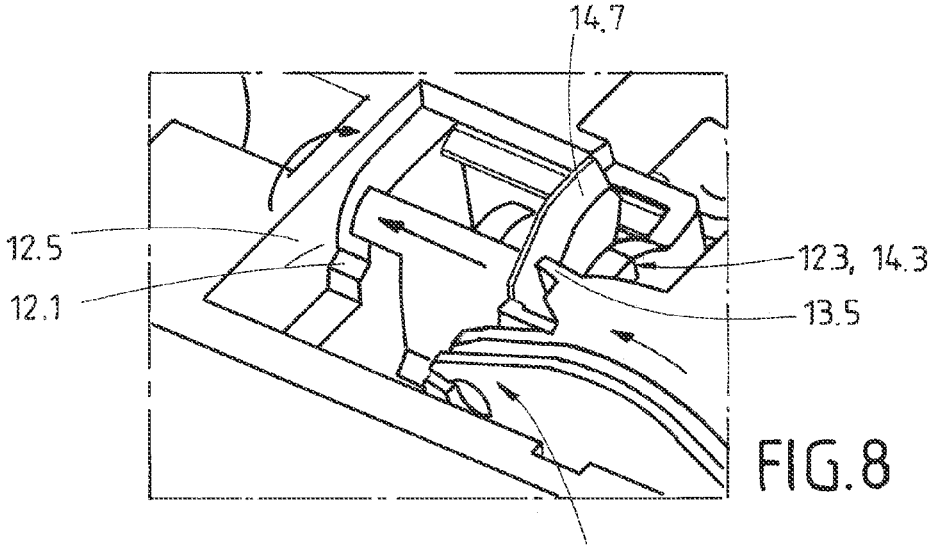
FIG. 8 shows a similar illustration of the crash block with the coupling unit as shown in FIG. 5 in the second blocking position of the crash block.
Figure 9:
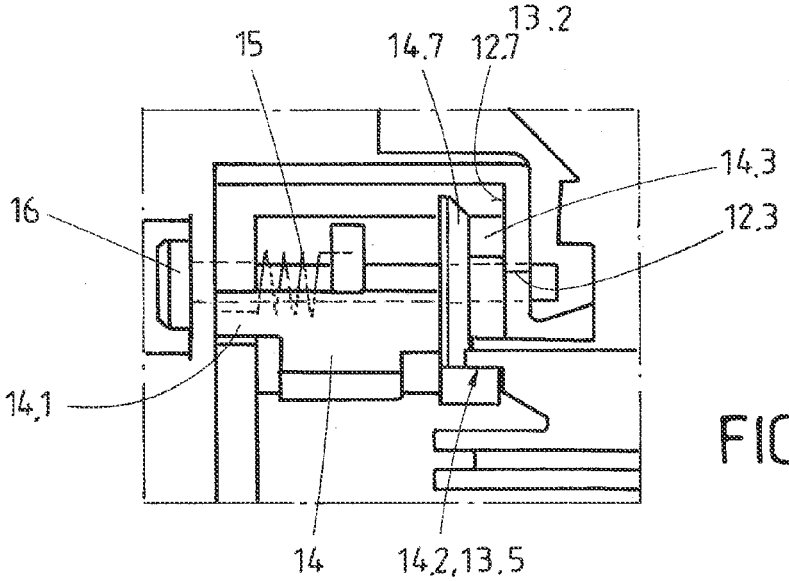
FIG. 9 shows a rear view of the door handle unit with the crash block in an intermediate position between the blocking position and the normal position, with the crash block blocking the door handle and/or the coupling unit.
Figure 10:
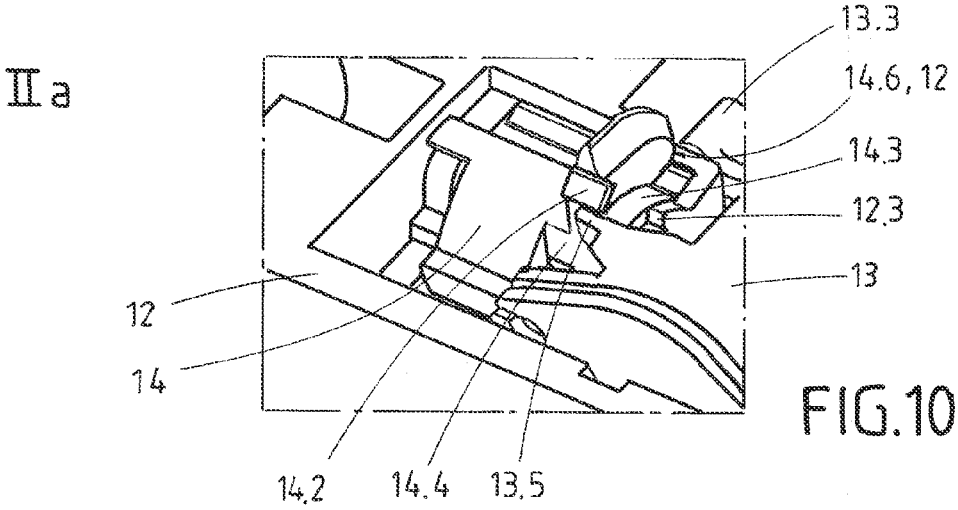
FIG. 10 shows a similar illustration of the door handle unit with the crash block of FIG. 8, with the coupling unit being discernible and the crash block being in the normal position.

FIGS. 3, 4, and 5 show a first phase A of the functional diagram of the door handle unit 10 according to the invention. FIGS. 6 and 7 show a second phase B. FIGS. 8, 9, and 10 show a third phase C of the functional diagram of the door handle unit 10 according to the invention. The entire functional diagram is shown purely schematically in FIG. 11 with the individual phases A, B, and C.

Figure 2:
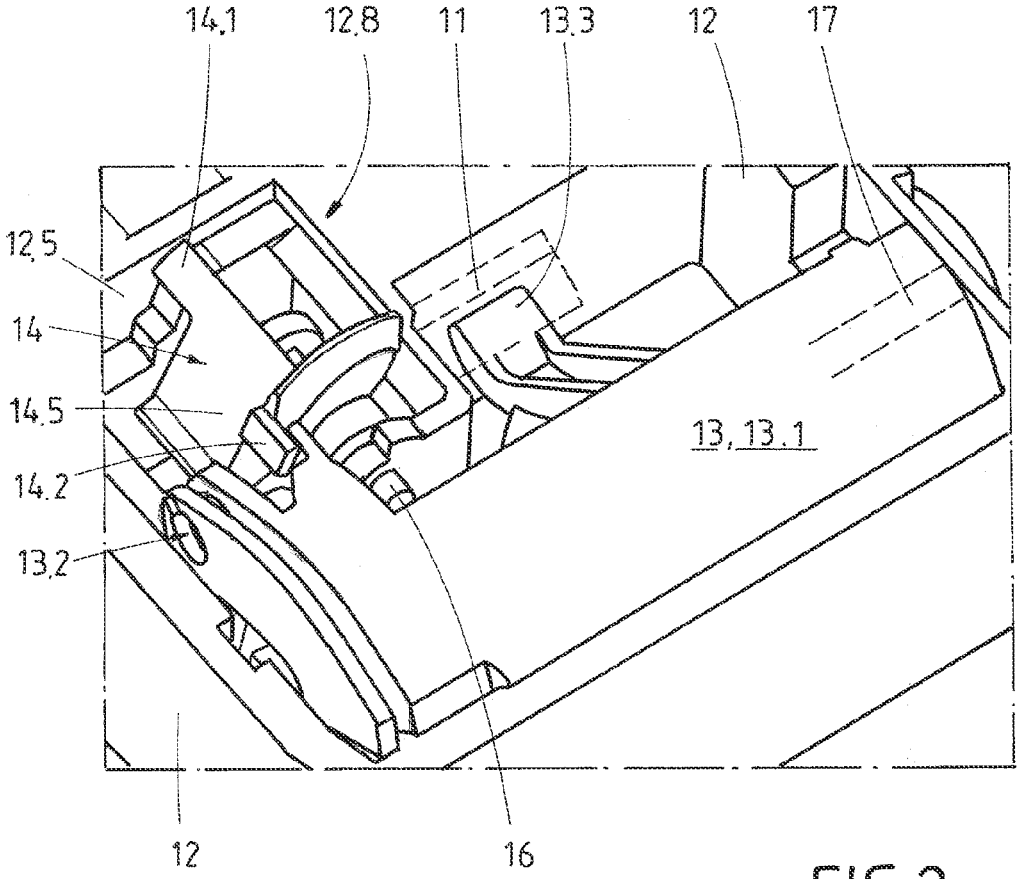
FIG. 2 shows a three-dimensional schematic rear view of the door handle unit of FIG. 1 in an intermediate blocking position.

In FIG. 2, the door handle unit 10 is shown with the coupling unit 13 and the crash block 14. Additionally, a portion of the door handle 11 is indicated in dot-dash lines in the form of an entraining hook, which mechanically cooperates with the accept 13.3 of the coupling unit 13. In the present case, this accept 13.3 is embodied like a lever and provided with additional reinforcement ribs. By this accept 13.3, a motion of the door handle 11 is introduced upon the coupling unit 13. The coupling unit 13 itself is fastened rotationally via the axis 17 at the bearing frame 12. The axis 17 is also indicated in dot-dash lines in FIG. 2 at the top right, because it is not visible in this illustration. The motion introduced by the door handle 11 upon the coupling unit 13 is transferred therefrom via a projection 13.2 to the transfer element of the lock 52. In the present case, the projection 13.2 is embodied for a Bowden cable, held at one end in a form-fitting fashion in the bore hole provided for said purpose. In order to reliably guide the Bowden cable, a guiding groove is entered in the bottom of the coupling unit 13. The coupling unit 13 further shows a counter-weight 13.1, which serves to counteract the weight of the door handle 11 in case of a crash or the impact of a force of acceleration. This way, the forces generated in case of a crash shall be largely compensated by the door handle 11 and the coupling unit 13. The counter-weight 13.1 is not mandatory for the coupling unit 13 provided here.

FIG. 2 also shows clearly the crash block 14 in its box-shaped accept 12.8 in the bearing frame 12. This crash block 14 is supported at its axis 16 rotational and also displaceable longitudinally, with the two ends of the axis 16 being held in the box-shaped accept 12.8. The crash block 14 also comprises a weight 14.5 in order, in case of an impacting force of acceleration during a crash, to generate an individual motion of the crash block 14 from its normal position IIa into at least a blocking position IIb. As described above, the crash block 14 temporarily precedes any motion of the coupling unit in order to affect a blockage of the coupling unit 13. It is also possible for the crash block 14 to directly block a motion of the door handle 11. In the following it is only described how the crash block 14 blocks a motion of the coupling unit 13, although the invention is not limited thereto. FIG. 2 shows the crash block 14 in an intermediate position, in which it prevents the motion of the coupling unit 13 in the direction of the operating position Ib in a form-fitting fashion.

FIG. 3 shows the crash block 14 in its normal position IIa; here the crash block 14 impinges the bearing frame 12 with a stop in its disc-segment 14.6, particularly the second side 12.6 of the box-shaped accept 12.8. The box-shaped accept 12.8 is embodied with four sides almost rectangular. The axle 16 is supported in the first side 12.5 and in the third side 12.7. In this normal position IIa the door handle 11 as well as the coupling unit 13 can be moved back and forth between the resting position Ia and the operating position Ib. For this purpose, a recess 14.4 or a clear space 14.4 is provided at the crash block 14, past and/or through which a projection 13.5 of the coupling unit 13 can be guided (see FIG. 10). This recess 14.4 is equivalent to a separated part of the disc segment 14.6. The crash block 14 shown comprises the stops 14.1, 14.2, and 14.3, with their functions being explained in greater detail in the following. The crash block 14 is supported by the first stop 14.1 and the third stop 14.3 with a lower play laterally in the box-shaped accept 12.8 between the first side 12.5 and the third side 12.7 in the bearing frame 12. By the impact of a force of acceleration 60, caused for example by a crash, the crash block 14 is rotated counter-clockwise due to its weight 14.5 about an axis 16 until it impinges with its stops 14.1 and/or 14.2 the bearing frame 12 or the respective counter-stops. Here, the crash block 14 performs a rotation by approx. 90° between the normal position IIa and a first blocking position IIb1. The rotary motion of the crash block in the counter-clockwise direction can be stopped both by the first stop 14.1 as well as the second stop 14.2, which are cooperating with respective counter-stops 12.1 and 12.4 at the bearing frame 12. It is also clearly discernible from FIG. 4 that the second stop 14.2 is arranged projecting perpendicularly in reference to the level of the disc-segment 14.6 of the crash block 14 and out of said level.

It is shown in FIG. 5 how the crash block 14 in the first blocking position IIb1 securely blocks any motion of the door handle 11 and/or the coupling unit 13. After the crash block 14 has preceded any motion of the coupling unit 13, said unit now also moves in the direction indicated by the arrow (also in the counter-clockwise direction about the axis 17). By this rotary motion, the projection 13.5 is pressed upon the disc-segment 14.6, preventing any further rotation of the coupling unit 13. By the compression of the coupling unit 13, the entire crash block 14 is also pressed in the direction towards the first side 12.5 of the bearing frame 12. Here, the first stop 14.1 contacts the first side 12.6 of the bearing frame 12, which forms a first, lateral counter-stop 12.1, thus securely preventing any further longitudinal motion of the crash block 14. Accordingly, the rotary motion of the coupling unit 13 is prevented in a form-fitting fashion, particularly by the cooperation of the disc segment 14.6 with the projection 13.5. The crash block 14 remains in the first blocking position IIb1 until the compression by the coupling unit 13 is released. By the large-area embodiment of the disc segment 14.6, it is ensured that the crash block 14 also cooperates with the coupling unit 13 in a form-fitting fashion when the crash block already rotates out of its first blocking position IIb1 in the direction of the normal position IIa, i.e., in the clockwise direction. This way, flutter motions and forces of acceleration 60 occurring in rapid succession can also be securely compensated by the crash block 14.

FIG. 6 now shows how the crash block 14, after reaching its first blocking position IIb1, is transferred in the direction of the second blocking position IIb2. Based on the first blocking position IIb1 (see FIGS. 4 and 5), the crash block 14 is shifted longitudinally by a spring 15 shown in FIG. 9 and rotated in the clockwise direction (towards the normal position IIa). The longitudinal direction and the direction of rotation are shown by respective arrows in FIG. 6. The spring 15 required here is provided in the form of a torsion and pressure spring. Of course, several springs may also be used in order to achieve the desired motion of the crash block 14. For example, it is also possible that a longitudinal displacement of the crash block 14 can be generated by a ramp-shaped projection at the first side 12.5 of the bearing frame 12, which, e.g., cooperates with the first stop 14.1 of the crash block. As further discernible from FIG. 6, the crash block 14 is shifted longitudinally so that a third stop 14.3 projects into an intermediate space between the third counter stops 12.3. The third stop 14.3 is embodied arched and projects from the face of the disc segment 14.6. Due to the fact that in FIG. 6 the rotary motion of the crash block 14 is not yet blocked in the clockwise direction, it can be further rotated until it assumes its second blocking position IIb2 from this intermediate position.

FIG. 7 shows the second blocking position IIb2, which represents a stable position of the crash block 14. The first blocking position IIb1 of the crash block 14 is, however, in a temporarily unstable position of the crash block because it is always rotated by the spring 15 in the counter-clockwise direction towards the normal position IIa or in the direction of the second blocking position IIb2.

In FIG. 7, the rotary motion of the crash block 14 is stopped by the third stop 14.3 with a third counter stop 12.3 at the bearing frame 12. From this second blocking position IIb2 the crash block 14 can only be rotated in the counter-clockwise direction and displaced longitudinally in the direction of the first side 12.5 of the bearing frame 12. In this second blocking position IIb2 the crash block 14 reliably blocks any motion of the coupling unit 13, as shown in the following FIGS. 8 and 9.

FIG. 8 shows the crash block 14 in the operating position IIb2 similar to FIG. 7, with the coupling unit 13 also being displayed. It is rotated by the crash in the direction of the arrow displayed, i.e., in the counter-clockwise direction, and now presses with its projection 13.5 onto the disc segment 14.6 of the crash block 14. The disc segment 14.6 comprises at its exterior edge a beveled engagement area 14.7, which cooperates with the projection 13.5 in the event of a crash. By the compression force of the projection 13.5 upon the beveled engagement area 14.7 the crash block 14 is only shifted longitudinally in the direction of the first side 12.5 by the bearing arm 12 (also see longitudinal arrow). Consequently the coupling unit 13 can also be rotated slightly further in the counter-clockwise direction, with it here not reaching the operating position Ib, though, which is required to operate the lock 52. As further discernible from FIG. 8, the crash block 14 initially cannot be rotated because the second stop 14.2 must glide along the width of the third counter stop 12.3 of the bearing frame 12. Only when the two stops 12.3 and 14.3 are no longer contacting each other can the crash block 14 be rotated clockwise.

FIG. 9 shows that now the third stop 14.3 has been longitudinally guided past the third counter stop 12.3 of the bearing frame 12 and the crash block 14 has been rotated in the direction of the normal position IIa (clockwise). This way the coupling unit 13 could also rotate a little further in the counter-clockwise direction, namely in the direction of the operating position Ib. However, it cannot reach this operating position Ib, because now the projection 13.5 of the coupling unit 13 impinges the second stop 14.2 of the crash block, by which any further movement of the coupling unit 13 is blocked in a form-fitting fashion. From this intermediate position, which also represents a blocking position, the coupling unit 13 now can be moved by a clockwise rotation, i.e., in the direction towards its resting position Ia. As soon as another crash or a manual motion of the door handle 11 has been introduced, said motion is only possible to the intermediate position of the crash block 14 shown in FIG. 9. Subsequently the door handle 11 and/or the coupling unit 13 first must be transferred into the resting position Ia, with the door handle 11 also being stressed with a spring, so that it is automatically transferred into this resting position Ia. Additionally, the coupling unit 13 is embodied in a spring-loaded fashion in order to automatically reach the resting position Ia. As soon as the door handle 11 and/or the coupling unit 13 reach the resting position Ia the crash block 14 can rotate further in the clockwise direction towards the normal position IIa. The already-mentioned spring 15 is provided for this purpose, which may also be provided at a position other than the one shown in FIG. 9 between the crash block 14 and the bearing frame 12.

As soon as the crash block 14 has returned into its normal position IIa the door handle 11 and/or the coupling unit 13 can once more freely move back and forth between the resting position Ia and the operating position Ib in order to operate the lock 52. This position is shown in FIG. 10, in which it is clearly discernible that the projection 13.5 glides unhindered from the coupling unit 13 along the recess 14.4 or the clear space 14.4 of the crash block 14.

Figure 11:
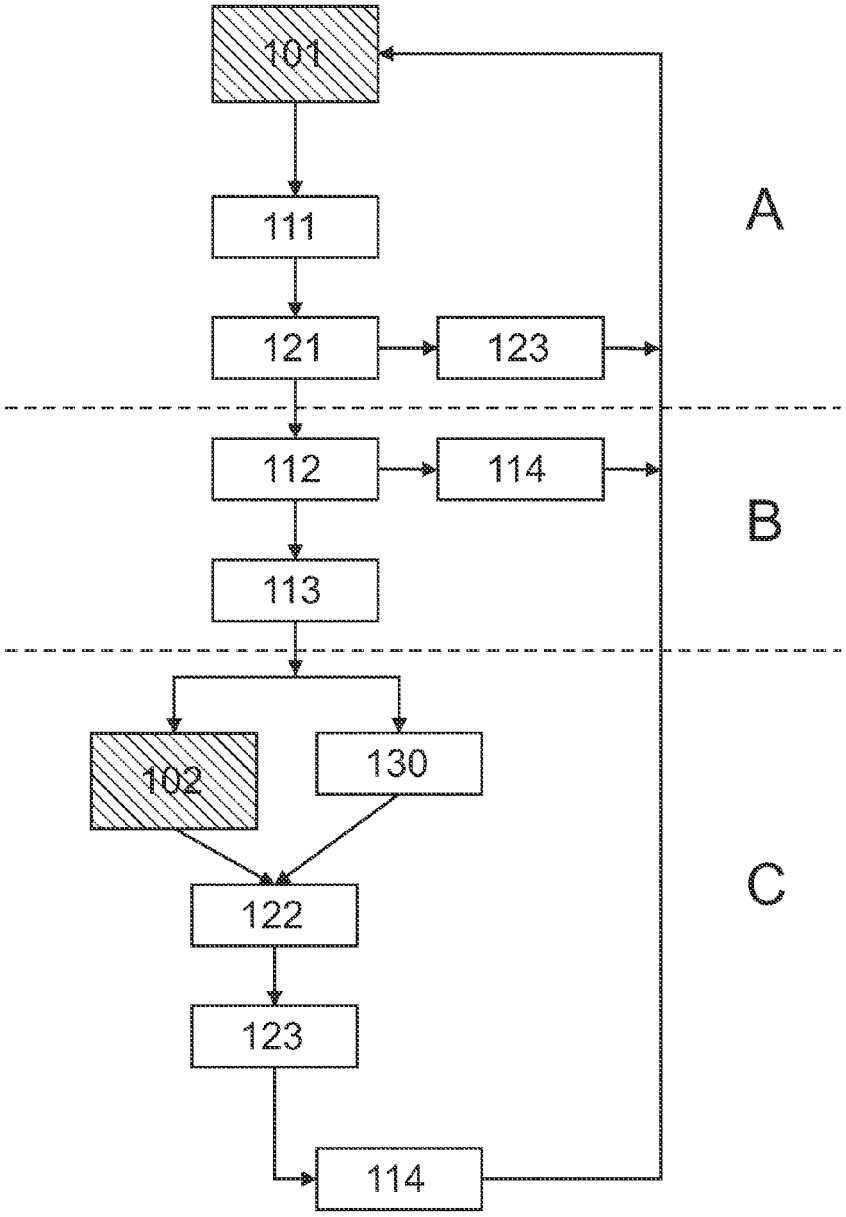
FIG. 11 shows a functional diagram for the door handle unit according to the invention during a crash.

FIG. 11 shows the functional diagram of the door handle unit 10 according to the invention in case of a crash. Here, the reference characters 101 and 102 indicate the first and second crash or the first impacting force of acceleration 60 and the second impacting force of acceleration 60. The individual phases A, B, and C are also marked in the functional diagram.

Phase A: Based on the first impact of a force of acceleration (see reference character 101) now the crash block 14 is rotated counter-clockwise towards the first blocking position IIb1 (see reference character III). Further, by this impacting force of acceleration 60 the coupling unit 13 is also rotated from the resting position Ia towards the operating position Ib, indicated by the reference character 121. Based on the reference character 121 now the coupling unit 13 can be rotated back into its resting position (see reference character 123).

Phase B: It is indicated by the reference character 112 that from the first blocking position IIb1 the crash block 14 is rotated counter-clockwise by the spring 15. This way the crash block 14 can be returned into its normal position IIa (see reference character 114), if no longitudinal displacement of the crash block 14 has occurred. However, if any longitudinal displacement has occurred by the spring 15 at the crash block 14, the crash block 14 stops in the second blocking position IIb2, indicated by the reference character 113.

Phase C: From this second blocking position IIb2 (see reference character 113) the crash block 14 can be transferred either by a second impacting force of acceleration (see reference character 102) or by a manual operation of the door handle 11 (see reference character 130) back into the normal position IIa. If in the second case a manual unlocking operation of the door handle 30 occurs (see reference character 130) the crash block 14 is displaced longitudinally against the force of the spring 15 and subsequently rotated out of the second blocking position IIb2 towards the normal position IIa. However, here the crash block 14 blocks the coupling unit 13, which first must be returned into its resting position in order to allow that the crash block 14 can be rotated completely into the normal position IIa. In the first case, in which in the second blocking position IIb2 another force of acceleration 60 acts upon the crash block 14 (see reference character 102) the coupling unit 13 is also blocked by the crash block 14 (see reference character 122) so that it now can be rotated in the direction of the resting position Ia. The rotation of the coupling unit 13 is shown with the reference character 123 in FIG. 11. Additionally, by the above-described motion of the coupling unit 13 from the reference characters 122 and 123 a longitudinal displacement and rotation of the crash block 14 occurs back into the normal position IIa, as already described for the reference character 114. Subsequently the crash block 14 has returned to its normal position IIa so that now either a new crash can occur or another normal operation of the door handle unit 10 can result.

Finally it shall be mentioned that the present invention is not limited to the exemplary embodiment shown; for example, as already mentioned, the stops of the crash block or the bearing frame may also be embodied at least partially as diagonal control surfaces in order to this way generate the longitudinal displacement of the crash block 14. Furthermore, mechanically complementary embodiments of the invention are also possible, which shall also be covered by patent protection.

The invention claimed is:

1. A door handle unit for a lock of a vehicle, comprising:

a door handle supported in an articulate fashion in a bearing frame to open a door, hatch, by a user, with the door handle comprising at least one resting position and one operating position, an operating unit, having at least the door handle, a coupling unit, or a combination of a door handle and the coupling unit, where by the mechanical coupling unit a motion of the door handle can be transferred from the resting position into the operating position of the lock, a crash block, having at least one normal position and at least one blocking position, the at least one blocking position having a first blocking position and a second blocking position, with the crash block in the normal position allowing a motion of the operating unit to operate the lock and in the blocking position, which may result during or after the impact of a force of acceleration as the result of a crash, blocking any motion of the operating unit such that any operation of the lock is avoided, wherein the crash block in the blocked position can be transferred by the motion of the operating unit into the normal position and, the crash block includes the first blocking position upon the impact of a force of acceleration and is rotated in the first blocking position only about an axis, the second blocking position, in which the crash block is held, and a first stop for engaging with a first bearing stop of the bearing frame when the crash block is in the first blocking position.

2. A door handle unit according to claim 1, wherein the crash block is held steady in the second blocking position.

3. A door handle unit according to claim 1, wherein the crash block is supported at the bearing frame in an articulate fashion.

4. A door handle unit according to claim 3, wherein the crash block is connected to a fixed weight.

5. A door handle unit according to claim 1, wherein the coupling unit is supported articulate at a bearing arm.

6. A door handle unit according to claim 5, wherein the coupling unit is connected to a fixed weight.

7. A door handle unit according to claim 1, wherein the axis is arranged at the bearing frame.

8. A door handle unit according to claim 1, wherein the crash block can be mechanically stressed by a spring, with the spring being embodied such that it transfers the crash block from at least one blocking position into the normal position.

9. A door handle unit according to claim 1, wherein the crash block is mechanically stressed by a spring, with the spring being embodied such that the crash block is transferred from the first blocking position into the second blocking position.

10. A door handle unit according to claim 9, wherein the crash block can be mechanically stressed by a spring, with the spring being embodied such that it transfers the crash block from at least one blocking position into the normal position, wherein the spring is embodied as a pressure and/or torsion spring or the crash block is mechanically stressed by a spring, with the spring being embodied such that the crash block is transferred from the first blocking position into the second blocking position, wherein the spring is embodied as a pressure and/or torsion spring.

11. A door handle unit according to claim 1,
wherein
the crash block blocks in at least one blocking position the motion of the operating unit in a form-fitting fashion.

12. A door handle unit according to claim 1,
wherein
at the operating unit at least one projection is arranged cooperating with the crash block.

13. A door handle unit according to claim 12,
wherein
the projection mechanically cooperates with the crash block in a form-fitting fashion.

14. A door handle unit according to claim 1,
wherein
the first stop of the crash block is a first lateral stop to the bearing frame.

15. A door handle unit according to claim 1,
wherein
the crash block comprises a second stop for the bearing frame.

16. A door handle unit according to claim 15,
wherein
the crash block comprises a second rotary stop to the bearing frame.

17. A door handle unit according to claim 15,
wherein
the crash block comprises a third stop for the bearing frame by which the crash block is held steady in the second blocking position.

18. A door handle unit according to claim 17,
wherein
the additional motion of the operating unit leads to an axial displacement of the crash block so that the third stop is without influence upon the bearing frame.

19. A door handle unit according to claim 18,
wherein
the second rotary stop of the crash block blocks the additional motion of the operating unit in a form-fitting fashion.

20. A door handle unit according to claim 15,
wherein
the second stop of the crash block also blocks any motion of the operating unit in a form-fitting fashion if the crash block first was arranged in the second blocking position.

21. A door handle unit according to claim 1,
wherein
the crash block in the second blocking position is rotated about an axis and is longitudinally displaced axially towards the normal position.

22. A door handle unit according to claim 1,
wherein
the crash block leaves the stable, second blocking position by an additional motion of the operating unit.

23. A door handle
for a lock of a vehicle with
door handle supported in an articulate fashion in a bearing frame to open a door, hatch, by a user, with the door handle comprising at least one resting position and one operating position,
an operating unit, having at least the door handle, a coupling unit, or a combination of a door handle and the coupling unit, where by the mechanical coupling unit a motion of the door handle can be transferred from the resting position into the operating position of the lock,
crash block, having a normal position and a plurality of blocking positions, with the crash block in its normal position allowing a motion of the operating unit to operate the lock and in the blocking positions, which may result during or after the impact of a force of acceleration as the result of a crash, blocking any motion of the operating unit such that any operation of the lock is avoided,
the crash block in the blocking positions can only be transferred by the motion of the operating unit into the normal position and,
the crash block is supported rotationally about an axis and axially displaceable in reference to said axis, in order to reach a respective position of the plurality of blocking positions, which may result during or after the impact of the force of acceleration.

24. A door handle unit according to claim 23,
wherein
the crash block comprises at least two blocking positions.

25. A door handle unit according to claim 23,
wherein
the crash block comprises a first blocking position upon the impact of a force of acceleration, and
the crash block comprises a second blocking position, in which the crash block is held.

26. A door handle unit according to claim 25,
wherein
the crash block is held steady in the second blocking position.

27. A door handle unit according to claim 23,
wherein
the crash block is supported at the bearing frame in an articulate fashion.

28. A door handle unit according to claim 27,
wherein
the crash block is connected to a fixed weight.

29. A door handle unit according to claim 23,
wherein
the coupling unit is supported articulate at the bearing arm.

30. A door handle unit according to claim 29,
wherein
the coupling unit is connected to a fixed weight.

31. A door handle unit according to claim 23,
wherein
the axis is arranged at the bearing frame.

32. A door handle unit according to claim 23,
wherein
the crash block can be mechanically stressed by a spring,
with the spring being embodied such that it transfers the crash block from at least one blocking position into the normal position.

33. A door handle unit according to claim 23,
wherein
the crash block is mechanically stressed by a spring,
with the spring being embodied such that the crash block is transferred from the first blocking position into the second blocking position.

34. A door handle unit according to claim 23,
wherein
the crash block can be mechanically stressed by a spring,
with the spring being embodied such that it transfers the crash block
from at least one blocking position into the normal position,
wherein the spring is embodied as a pressure and/or torsion spring
or
the crash block is mechanically stressed by a spring,
with the spring being embodied such that the crash block is transferred from the first blocking position into the second blocking position,
wherein
the spring is embodied as a pressure and/or torsion spring.

35. A door handle unit according to claim 23,
wherein
the crash block blocks in at least one blocking position the motion of the operating unit in a form-fitting fashion.

36. A door handle unit according to claim 23,
wherein
at the operating unit at least one projection is arranged cooperating with the crash block.

37. A door handle unit according to claim 36,
wherein
the projection mechanically cooperates with the crash block in a form-fitting fashion.

38. A door handle unit according to claim 23,
wherein
the crash block comprises a first stop towards the bearing frame.

39. A door handle unit according to claim 38,
wherein
the crash block comprises a first lateral stop to the bearing frame.

40. A door handle unit according to claim 38,
wherein
the crash block comprises a second rotary stop to the bearing frame.

41. A door handle unit according to claim 23,
wherein
the crash block comprises a second stop for the bearing frame.

42. A door handle unit according to claim 23,
wherein
the crash block in the second blocking position is rotated about an axis and is longitudinally displaced axially towards the normal position.

43. A door handle unit according to claim 42,
wherein
the crash block comprises a third stop for the bearing frame by which the crash block is held steady in the second blocking position.

44. A door handle unit according to claim 23,
wherein
the second stop of the crash block also blocks any motion of the operating unit in a form-fitting fashion if the crash block first was arranged in the second blocking position.

45. A door handle unit according to claim 23,
wherein
the crash block leaves the stable, second blocking position by an additional motion of the operating unit.

46. A door handle unit according to claim 23,
wherein
the additional motion of the operating unit leads to an axial displacement of the crash block so that the third stop is without influence upon the bearing frame.

47. A door handle unit according to claim 46,
wherein the second rotary stop of the crash block blocks the additional motion of the operating unit in a form-fitting fashion.

48. A door handle unit according to claim 23, wherein the crash block is rotated in the first blocking position only about the axis and the crash block comprises a stop for the bearing frame.

49. A method for securing a door handle unit for a lock in a vehicle with
a door handle supported in a bearing frame in an articulate fashion to open a door, hatch, by a user with the door handle comprising at least one resting position and one operating position,
providing an operating unit having at least the door handle, a coupling unit, or a combination of a door handle and the coupling unit,
transferring a motion of the door handle via the mechanical coupling unit to the lock from the resting position into the operating position,
providing a crash block having a normal position and at least one blocking position having a first blocking position and a second blocking position, with the crash block in the normal position allowing a motion of the operating unit to operate the lock and in the blocking position, which may result during or after the impact of a force of acceleration caused by an accident, blocking the motion of the operating unit such that an operation of the lock is avoided, and
transferring the crash block in the blocking position by the motion of the operating unit into the normal position,
wherein the crash block includes the following steps:
rotating the first blocking position only about an axis upon the impact of a force of acceleration on the first blocking position,
holding the crash block in the second blocking position, and
providing a first stop for engaging with a first bearing stop of the bearing frame when the crash block is in the first blocking position.

50. A method for securing a door handle unit according to claim 49,
wherein
during the impact of a force of acceleration the crash block is automatically transferred into the first blocking position and an existing motion of the operating unit is blocked such that any operation of the lock is securely prevented.

51. A method for securing a door handle unit according to claim 50,
wherein
upon the impact of a force of acceleration the crash block is automatically transferred by a rotation into the first blocking position.

52. A method for securing a door handle unit according to claim 50,
wherein
the blocked motion of the operating unit causes the crash block to subsequently assume the normal position.

53. A method for securing a door handle unit according to claim 49,
wherein
the crash block is transferred from the stable, second blocking position into the normal position only by an additional motion of the operating unit.

54. A method for securing a door handle unit according to claim 53,
wherein
the additional motion is first blocked by the crash block in a form-fitting fashion.

55. A method for securing a door handle unit according to claim 49,
wherein
the crash block only assumes the normal position when the door handle is moved into the resting position.

* * * * *